United States Patent [19]

Aidn et al.

[11] 4,027,131

[45] May 31, 1977

[54] SPRING CONTACT ASSEMBLY

[75] Inventors: Martin Aidn, Degerndorf, near 87; Franz Rappl, Feldkirchen-Westerham, both of Germany

[73] Assignee: Siemens Aktiengesellschaft, Berlin & Munich, Germany

[22] Filed: Sept. 5, 1975

[21] Appl. No.: 610,758

[30] Foreign Application Priority Data

Sept. 13, 1974 Germany ..... 2443966

[52] U.S. Cl. ..... 200/246; 335/135

[51] Int. Cl.[2] ..... H01H 1/26

[58] Field of Search ..... 200/1 A, 1 TK, 1 B, 200/1 V, 237–292; 335/135

[56] References Cited

UNITED STATES PATENTS 2,831,939 4/1958 Alizon et al. ..... 335/135

3,689,856 9/1972 Lambert et al. ..... 200/242 X 3,819,896 6/1974 Aidn et al. ..... 200/283

*Primary Examiner*—Robert K. Schaefer

*Assistant Examiner*—Morris Ginsburg

*Attorney, Agent, or Firm*—Hill, Gross, Simpson, Van Santen, Steadman, Chiara & Simpson

[57] ABSTRACT

A spring electrical contact assembly having an elongated spring member with a contact adjacent a free end, the member mounted at an inner end in a slot opening in an insulated mounting body. The contact is urged by its spring force against a fixed contact carried by a stiff member mounted in the body. The inner end of the spring is fixed to a rigid spring carrier plate seated in the slot, the plate extending parallel to the elongation of the spring and having an edge at a right angle thereto intermediate the spring ends. The edge functions as a fulcrum point for the spring.

12 Claims, 5 Drawing Figures

Fig. 1
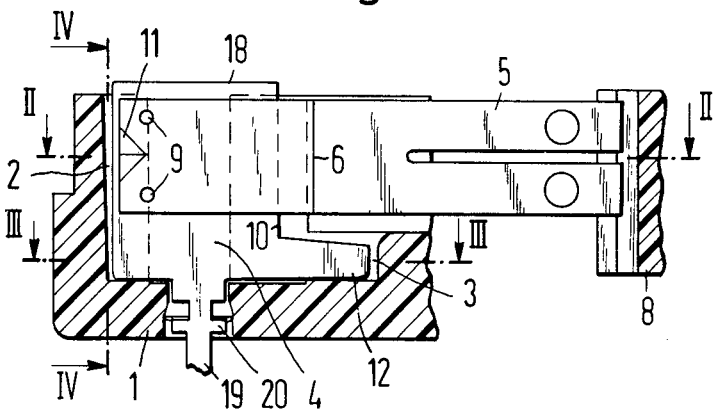
Fig.4
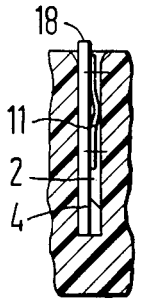
Fig. 2
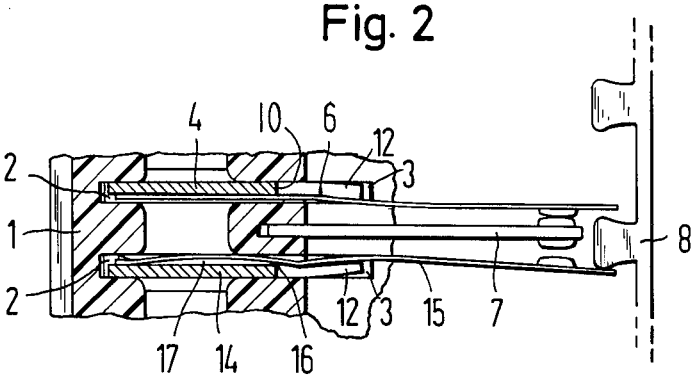
Fig. 5
Fig. 3
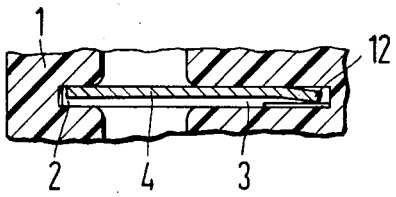
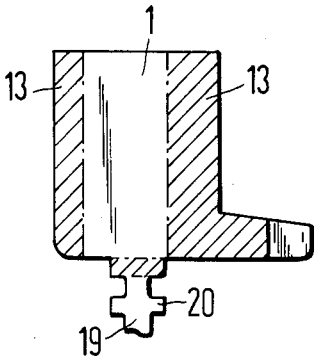

SPRING CONTACT ASSEMBLY

BACKGROUND OF THE INVENTION

1. Field of the Invention

This invention relates to spring electric contact assemblies in which a resilient spring having a contact at a free end projects from an insulating body member in which it is anchored.

2. Prior Art

Spring contact devices, particularly relay devices, which utilize a movable contact spring which is secured at one end to a substantially rigid spring carrier or mounting member and which has a free end carried contact which is biased towards an opposed fixed contact and wherein the spring carrying member is angularly secured in guide slots of an insulated body are known to the art.

A contact spring arrangment of this type is shown in U.S. Pat. No. 3,819,896 wherein a contact spring carrier is utilized which is clamped in an insulating body in an L-shaped configuration with respect to the spring with the spring projecting therefrom. This type of construction allows a considerable actual contact spring free length while at the same time providing a good seat in the insulating body.

However, with the typical prior art construction, above described, the length of the spring necessitates laterally supporting the contact springs on an abuttment of the insulating body in order to produce the requisite bias force. In the known arrangement, the abuttment is formed by a protrusion of the insulating body and the bias bend of the contact spring rests on the protrusion. This has the disadvantage that variations in dimensioning of the insulating body with regard to the support wall or in the dimensioning of the spring receiving slot in the insulating body or in the spring itself can all accumulate unfavorably to the final construction. This in turn can result in a corresponding variance in the contact force at the contact end of the spring. Particularly, at high temperature loads, the danger exists that the insulating body support point will become deformed and that the spring force at the contact will thereby alter. This possibility of variance in contact force must therefore be taken into account in the design of the contact actuator system so that, for example, for safety reasons, the selected contact response actuation perameters must be designed higher than desired.

SUMMARY OF THE INVENTION

It is therefore the object of this invention to design a contact spring arrangement of the type above described in a manner that assures a low variance of contact spring force without imposing high critical accuracy demands in production. However, at the same time, it is desired to maintain the greatest possible free spring length. According to the teachings of our invention, these objects are obtained by uitlizing a substantially rigid spring carrier attached to the spring on the side of the spring opposite the contact, the carrier forming a support or fulcrum edge for the contact spring at a right angle to the longitudinal extension of the spring.

A spring assembly constructed according to the teachings of this invention utilizing the herein disclosed spring carrier is, therefore, provided with both a stable support in the insulation body and a desired spring length. The contact spring is secured to the spring carrier adjacent one edge thereof, the spring carrier being preferably formed as a stable or substantially rigid plate member. The spring rests on a parallel edge of the spring carrier opposite the attachment edge with the spring extending approximately parallel to the major alignment of the spring carrier plate. Thus, in operation, the spring is freely mobile over the length of the plate and, therefore, can also be bent outwardly with respect to the plate. The fact that the contact spring is carried by and supported by its associated spring carrier insures a directionally stable, good, seat, which results in a very low variance of contact spring force. Particularly, even at high temperatures, the aforementioned danger of deformation of the spring support or fulcrum and its associated variance in contact force, is avoided.

Additionally, by utilizing this construction, an important added benefit is obtained. It is possible to eliminate the previously used expensive hardened resin or duo plastic insulator body and to replace it with a cheaper thermoplastic or unhardened resin insulator body an example of a insulator body is shown in U.S. Pat. No. 3,824,511 to Aidn et al issued July 16, 1974. Further, the substantially rigid spring carrier not only provides support for the spring during operation, but also provides protection during assembly of the contact spring device. By projecting a top side of the spring carrier beyond the insulating body, an abuttment face is therefore provided which can be used to firmly press the spring and spring carrier unit into the plastic insulating body without thereby endangering the more delicate precisely biased spring member.

The totality of reduction achieve in the contact force variance from the prior art provides a corresponding reduction in the angular deviation necessary for accurately positioning the contact end of the spring. These factors produce a more favorable force-path characteristic with a lower response exitation and a greater production reliability while maintaining a corresponding reduction in production cost.

In the preferred embodiment of this invention both the contact spring and the spring carrier are enclamped in a common slot in the insulating body. In the region of the common enclampment point, the contact spring is connected to the spring carrier by spot welding. Also, in the preferred embodiment shown, the contact spring is provided with a peaked protrusion or roof shaped bend in the area of the clamping point. Thus, the spring, together with the spring carrier, will be safely enclamped in the guide slot of the insulating body. Additionally, the spring carrier itself is expediently clamped in a further portion of the guide slot, which runs parallel to the contact spring, spaced from the common clamping point, by a bent over lug portion of the spring carrier. Additionally, it is advantageous if the spring carrier abuts its side opposite the contact spring against a support surface of the insulating body in areas other than the enclampment point. This provides for increased rigidity and directional stability without in any way limiting mobility of the contact spring.

It is therefore an object of this invention to provide an improved contact spring arrangement wherein the contact spring is affixed to a spring carrier which is received in an insulating body in a somewhat L-shaped manner, the spring carrier providing a fulcrum point for the contact spring.

It is another and more particular object of this invention to provide a contact spring arrangement wherein the spring which has a contact adjacent one end is affixed to a spring carrier adjacent its opposite end, the spring carrier comprising a plate-like member extending parallel to the spring for a portion for a length of the spring and having an edge intermediate the point of attachment of the spring and the contact end of the spring which functions as a fulcrum point for the spring, the cotact spring and spring carrier being commonly received in a slot in an insulation body.

Other objects, features and advantages of the invention will be readily apparent from the following description of a preferred embodiment thereof, taken in conjunction with the accompanying drawings, although variations and modification may be effected without departing form the spirit and scope of the novel concepts of the disclosure, and in which:

BRIEF DESCRIPTION OF THE DRAWINGS

FIG. 1 is a fragmentary cross sectional view of a contact spring assembly constructed according to this invention.

FIG. 2 is a fragmentary cross sectional view of the assembly of FIG. 1 taken along the lines II—II of FIG. 1.

FIG. 3 is a fragmentary cross sectional view taken along the lines III—III of FIG. 1.

FIG. 4 is a fragmentary vertical cross sectional view taken along the lines IV—IV of FIG. 1.

FIG. 5 is a fragmentary plan view of the spring carrier according to this invention, illustrating, by shaded sections, contact surfaces with the insulating body.

DESCRIPTION OF THE PREFERRED EMBODIMENT

The contact spring arrangement of our invention, as shown in FIGS. 1 to 5, includes a contact spring 5 and spring carrier 4 in an insulating body 1. The spring and spring carrier are received, preferably, in guide slots 2 and 3 which are aligned with one another. The spring carrier 4 is basically plate shaped and a resilient movable contact spring 5 is secured thereto. The spring is biased by a biasing bend 6 towards a fixed counter contact carrier 7 which is also mounted in the insulating body. The contact spring 5 can be operated by a slide member 8 or the like.

In the area of enclampment of the contact spring and spring carrier in the guide slot 2, the contact spring 5 is attached to the spring carrier 4, as by means of welding spots 9 or the like. Otherwise the contact spring runs approximately parallel to the plate shaped spring carrier and is free to move relative thereto. An edge 10, of the contact spring carrier, parallel to and opposed, to an edge forming the back of the spring carrier adjacent to the point of attachment, forms a fulcrum point for the spring. The edge 10 lies intermediate the dimensioning of the insulating body and therefore, the spring carrier is also pressed into the insulating body at the point of the edge 10. Because the contact spring is attached to its own spring carrier it exhibits good stability without its mobility being limited. This is graphically illustrated, for example, in FIG. 2, with respect to the contact spring 15 which is currently being operated by the slide 8. This spring is secured to the spring carrier 14 and engages the spring carrier edge 16. That portion of the spring intermediate the point of fixation of the spring to the spring carrier and the edge 16, if free to curve outwardly in the region 17 away from the spring carrier. This allows exploitation of the large effective spring length thereby allowing the contacts to be spaced considerably from the attachment portion of the insulating body. In such a manner, the force-path characteristic of the spring is optimized.

To improve the seating of the spring carrier 4 and the contact spring 5 in the guide slot 2, the contact spring is provided with a protrusion 11, which is preferably peaked in the manner of a triangular roof section. Thus, the spring carrier is pressed into the insulating body 1 with one side of the spring carrier, in contact with the insulating body, In order to maintain this forcing of the spring carrier to one side of the slot, a lug 12 projects forwardly of the edge 10 into the aligned guide slot 3 and is bent, as shown in FIG. 3 to urge the main portion of the spring carrier into bearing contact with the insulating body. The lug 12 is therefore effective, especially when combined with the peak 11, to press the spring carrier against bearing surfaces of the insulating body. The areas of contact of the spring carrier against the insulating body are illustrated as the shaded areas of FIG. 5. This provides the spring carrier with both good rigidity and directional stability so as to properly support and maintain the contact spring.

Additionally, the spring carrier preferably has a height greater than the depth of the slot in the insulation block. Therefore, during installation of the spring and spring carrier into the insulated body, the unit may be gripped by an insulating tool at the projecting end face 18 and pressed into the guide slots 2 and 3. Thus the end face 18 provides an abuttment face to aid in installation without in any way damaging the spring. Subsequent to pressing the unit into the slots, the lug 19, with attached wings 20 is twisted to seat the unit. During this activity, the end face 18 can serve as a counter support.

It can therefore be seen from the above that our invention provides a spring contact assembly wherein the individual contact springs have a contact adjacent a longitudinal free end thereof. The inner or opposite longitudinal end is affixed to a plate shaped spring carrier. The spring carrier has a length running parallel to the length of the spring for a portion thereof and provides a fulcrum edge for the spring intermediate the ends of the spring. The combination of the contact spring and the spring carrier is inserted in a slot in an insulating body with the spring carrier being urged against one wall of the slot whereby the spring free to move within the slot.

Although the teachings of our invention have herein been discussed with reference to specific theories and embodiments, it is to be understood that these are by way of illustration only and that others may wish to utilize our invention in different designs or applications.

We claim as our invention:

1. A contact spring assembly comprising an insulating body with a guide slot therein, a movable resilient elongated contact spring having a contact at a free end spring biased towards a counter contact member, the end opposite the free end affixed to a substantially rigid spring carrier, the spring carrier received in the guide slot in the insulating body, the spring carrier attached to the contact spring on a side of the contact spring opposite the contact, the spring carrier having an edge spaced from the point of attachment of the spring to the spring carrier in the direction of the free end of the spring to allow a portion of said spring to be bent within said slot, with a portion of the contact spring including the free end projecting beyond the edge, the spring, intermediate the ends, contactable with the edge, and the edge forming a fulcrum for the spring at substantially right angles to the longitudinal extent of the spring.

2. A contact spring assembly according to claim 1 wherein the spring carrier is substantially plate shaped.

3. A contact spring assembly according to claim 2 wherein the contact spring and its associated spring carrier are commonly clamped in the guide slot in the insulating body.

4. A contact spring assembly according to claim 3 wherein the spring carrier and associated contact spring are attached to one another by spot welding in the region of enclampment in the guide slot.

5. A contact spring assembly according to claim 4 wherein a peaked protrusion is provided on the contact spring adjacent the end of the contact spring opposite the free end and in the area of enclampment in the slot.

6. A contact spring assembly according to claim 5 wherein the spring carrier abuts a side wall of the slot on the side of the spring carrier opposite a side to which the spring is attached.

7. A contact spring assembly according to claim 6 wherein the spring carrier has a projecting lug portion received in a guide slot in the insulating body, the lug portion being bent from the plane of a major portion of the spring carrier contacting a wall of the slot opposite a second slot wall abutted by the side of the spring carrier and the spring carrier is urged into abuttment with the second slot wall of the slot by the bent lug portion and the peaked protrusion of the contact spring, the lug portion being spaced from the peaked protrusion.

8. A contact spring assembly comprising an insulating housing having a slot therein, a contact spring and spring carrier received in said slot with the contact spring projecting from said slot, the contact spring and spring carrier having substantially parallel opposed surfaces, the contact spring attached to the spring carrier at at least one point along the opposed sufaces, the spring carrier having an edge spaced from the point of attachment in the direction of projection of the contact spring from the slot to allow a portion of said spring to be bent within said slot, the edge serving as a fulcrum point for the contact spring intermediate ends of the contact spring.

9. The assembly of claim 8 wherein the edge extends substantially at right angles to the longitudinal extent of the contact spring.

10. The assembly of claim 9 wherein the edge is positioned interiorly of the slot in the insulating housing receiving the spring and spring carrier.

11. The assembly of claim 10 wherein the slot has a width greater than the combined thickness of the spring carrier and the spring, the spring having a projection thereon extending away from the spring carrier in the area of attachment, the projection engaging a slot wall and urging the spring carrier against an opposite slot wall, the spring carrier having a projecting lug thereon, the projecting lug being bent from the plane of the majority of the spring carrier into engagement with a slot wall to urge the spring carrier against the said opposite slot wall.

12. A contact spring assembly for electromagnetic relay switching devices comprising a base member of insulating material having at least one slot receiving a contact spring and a contact spring carrier with the contact spring having a free end projecting from the slot, the contact spring free end having a contact thereon, and an end opposite the free end attached to the spring carrier in an area within the slot, the spring carrier and the contact spring extending substantially parallel to one another in the slot from a point of common mounting within the slot in the direction of the free spring end, the spring carrier having an edge intermediate the length of the contact spring extending at substantially right angles to the direction of projection of the free end, the edge forming a fulcrum point against which a portion of the contact spring rests, the width of the slot being greater than the combined width of the spring carrier and contact spring for a portion of the distance between the point of attachment of the contact spring to the spring carrier and said edge whereby said contact spring is free to bow with respect to a side wall of the contact spring carrier intermediate the point of attachment and the edge within the area of the slot and the contact spring and spring carrier enclamped between side walls of the slot at a point spaced from the edge in the direction opposite the projection of the free end.

* * * * *